United States Patent [19]

Cheak

[11] 4,100,661

[45] Jul. 18, 1978

[54] DOOR HINGE APPLYING APPARATUS

[75] Inventor: Edward G. Cheak, Chico, Calif.

[73] Assignee: Norfield Manufacturing Co.,, Chico, Calif.

[21] Appl. No.: 687,787

[22] Filed: May 19, 1976

Related U.S. Application Data

[62] Division of Ser. No. 520,200, Nov. 4, 1974, Pat. No. 3,979,817.

[51] Int. Cl.[2] ..... B27F 5/12; B27M 1/08

[52] U.S. Cl. ..... 29/33 K; 29/56.6; 29/428; 29/787; 144/3 E; 144/27; 144/32 R

[58] Field of Search ..... 144/3 R, 3 E, 27, 32 R, 144/288 R; 29/200 R, 200 A, 208 R, 428, 429, 430, 434, 33 K, 56.6, 787, 33 P

[56] References Cited

U.S. PATENT DOCUMENTS

| | | | |
|---|---|---|---|
| 2,832,381 | 4/1958 | Sherwood | 144/32 |
| 3,263,723 | 8/1966 | Sheffield et al. | 144/3 R X |
| 3,772,757 | 11/1973 | Goldstein | 144/32 X |
| 3,854,889 | 12/1974 | Lemelson | 29/33 P |

*Primary Examiner*—Othell M. Simpson
*Assistant Examiner*—Z. R. Bilinsky
*Attorney, Agent, or Firm*—Townsend and Townsend

[57] ABSTRACT

A door hinge applying unit for supporting and releasably holding a door and the hinge jamb of the door frame in positions alongside each other with the butt-receiving surfaces of the door and jamb coplanar for applying the butts of a butt hinge, which unit includes a butt mortiser for simultaneously forming the mortises for said butts, a drilling device for forming the holes for the screws to secure said butts in said mortises, and a screw driving assembly for holding the hinge to be applied with the butts thereof opposed to said mortises, and for holding the screws for securing said butts in said holes in alignment with the latter. The unit includes actuating means for automatically actuating said mortiser, drilling device and screw driving and butt applying assembly, in succession, for (a) simultaneously mortising said surfaces for said butts, (b) then simultaneously drilling said holes, and then (c) positioning the butts in said mortises and simultaneously driving all of the screws for securing said butts in said mortises through the screw openings in said butts and into the previously formed screw holes in the butt mortises for tightly securing the butts in the mortises and to the door and hinge jamb.

8 Claims, 19 Drawing Figures

A.
B.
C.
D.
E.

DOOR HINGE APPLYING APPARATUS

This is a division of application Ser. No. 520,200, filed Nov. 4, 1974 and now issued U.S. Pat. No. 3,979,817.

BACKGROUND OF THE INVENTION

The operation of fabricating pre-hung doors at a factory, in which each door is hung from or secured to the hinge jamb of a door frame by butt hinges prior to the installation of the door frame in the door opening at the building site, is old. The replacement of the task of individually fitting and hanging each door at the building site has resulted in great savings in time as well as greater accuracy.

SUMMARY

The apparatus of this invention positions a door and jamb for sequential formation of mortises therein, drilling of screw holes in the mortises, and locating and securing the butts of hinges in the mortises.

One of the objects of this invention is the provision of a hinge applying unit that saves still more time, and with greater accuracy, than heretofore, in applying the butt hinges to the hinge jambs and doors.

Another object of the invention is the provision of a hinge applying unit in which the several steps of mortising the hinge edge of the door and the hinge jamb, and the application and securement of the butts of each hinge to the door, including the making of the holes for the attaching screws are automatic, one following the other in proper sequence.

A still further object of the invention is the provision of an improved hinge applying assembly for securing each butt hinge on the door and hinge jamb, and the method of so applying the butt hinge.

Another object is the provision of a cooperative relationship between the hinge applying assemblies and a door automatically fed to a hinge applying position, and the position of an operator for manually positioning a hinge jamb to be hingedly secured to said door by said assemblies, that enables a substantial saving in labor and time.

Other objects will appear in the description and drawings.

DETAILED DESCRIPTION

Figures 1, 2:
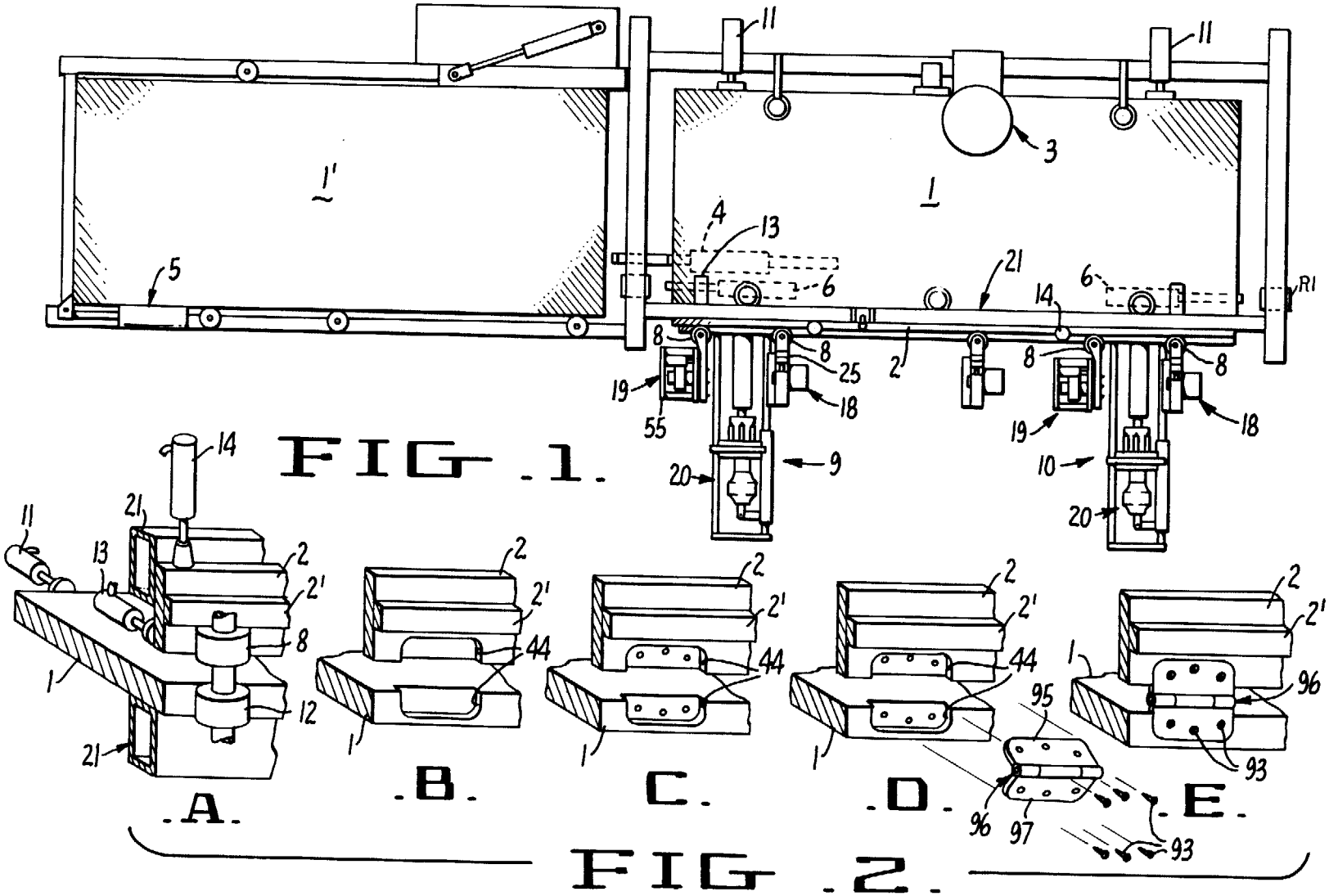
FIG. 1 is a simplified top plan view of hinge applying apparatus embodying the invention, including a door and hinge jamb in a position for application by the hinge applying units, and a door on an automatic feeder in a position to be fed to the hinge applying apparatus.
FIG. 2 is a series of isometric, fragmentary views showing the successive steps in the automatic application of one of the butt hinges to a door and hinge jamb.

Referring to FIG. 1 a horizontally disposed door 1 is shown in a position for application of the butt hinges.

Door 1 was the top door 1' of a vertical stack of vertically aligned, horizontal doors supported on a conventional scissors lift that automatically maintains the top door at a level for removal longitudinally of the door to the position occupied by door 1 after door 1 has been connected by butt hinges with hinge jamb 2 and during removal from the hinge applying machine.

In actual practice the hinge applying machine includes a latch bolt faceplate router, a latch drill and a lock drill assembly generally designated 3, which are actuatable for preparing the door for the latch bolt face plate, latch and lock at the same time the butt hinges are applied.

After the hinge jamb 2 is hingedly connected to the door, a fluid actuatable door cylinder 4 is actuatable to move the door 1 and the jamb connected therewith to the right for engagement with a power driven roller (R1) for removing the door from the machine.

Fluid actuatable door positioning cylinders 6 are adapted to position the door 1 lengthwise for attachment of the butt hinges thereto.

Hinge jamb 2, which includes the door stop 2', is manually positioned above the butt receiving edge of the door 1 with the door stop 2' on the upper axially facing surfaces of rollers 8 (FIG. 1 and Sta. A, FIG. 2). The rollers 8 of a pair are spaced apart at each of the hinge applying assemblies generally designated 9, 10. A third pair may be spaced between the two assemblies shown, if a third hinge is to be applied.

Fluid actuatable cylinders 11 along the edge of door 1 opposite the hinge applying assemblies are actuated to urge the hinge receiving surfaces of the door against the radially outwardly facing surfaces of rollers 12 that are on the same shafts as rollers 8 (Sta. A, FIG. 2) and cylinders 13 are actuatable to urge the hinge-receiving surface on the hinge jamb 2 against the radially outwardly facing surfaces on rollers 8, thus accurately holding the butt-receiving surfaces on the door and jamb in a vertical plane parallel with and spaced above the door 1. Fluid actuatable cylinders 14 above jamb 2 are actuatable for releasable holding the jamb downwardly during the hinge applying operations.

Before describing in detail the pair of hinge applying assemblies 9, 10, each assembly comprises three units, namely; the butt mortiser, generally designated 18, the drilling device generally designated 19 for drilling the holes in the mortises that are to receive the screws that secure the butts of the hinge to the door and hinge jamb, and the hinge applying and screw driving unit generally designated 20 for carrying, positioning and releasably holding the butts of the hinge in the mortises formed in the door and hinge jamb with their screw opening in alignment with the holes for the screws, and for releasable holding the butt securing screws in alignment with the holes in the butts, door and jamb and for driving said screws into the holes in the door and jamb through the screw openings in the hinge butts for tightly securing said butts to the door and hinge jamb.

The mortiser 18, and the drilling device 19 are hingedly supported on the frame 21 of the machine at opposite sides of the area in the door and jamb to be mortised, while the hinge and screw carrier 20 is supported for recirprocation toward and away from said area.

Butt Mortiser

Figure 6:
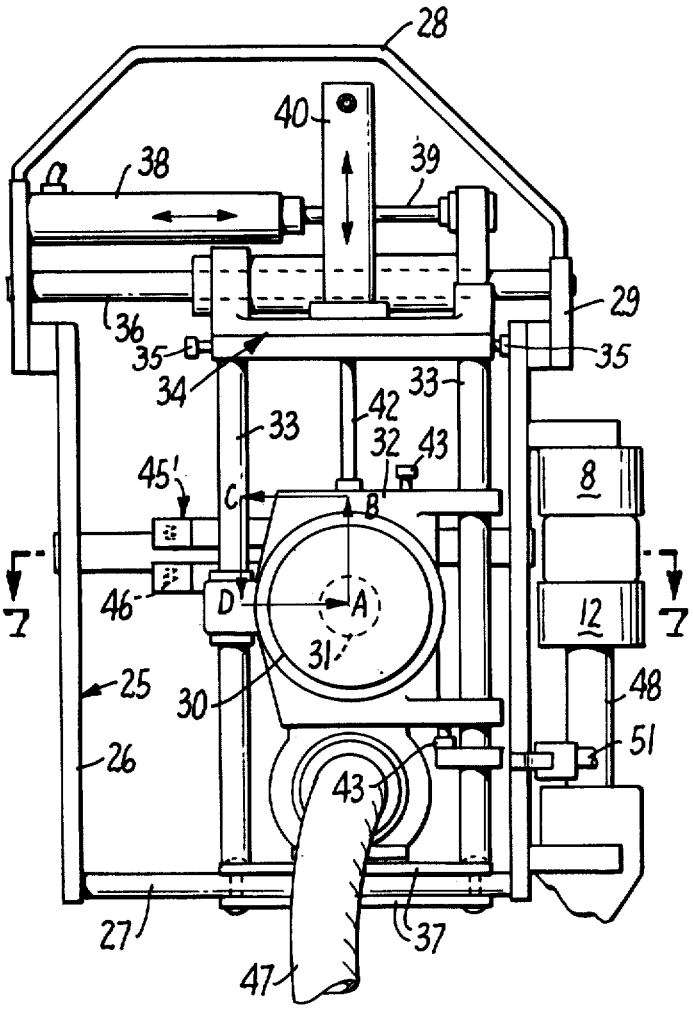
FIG. 6 is a side elevational view as seen from line 6—6 of FIG. 5.
Figure 7:
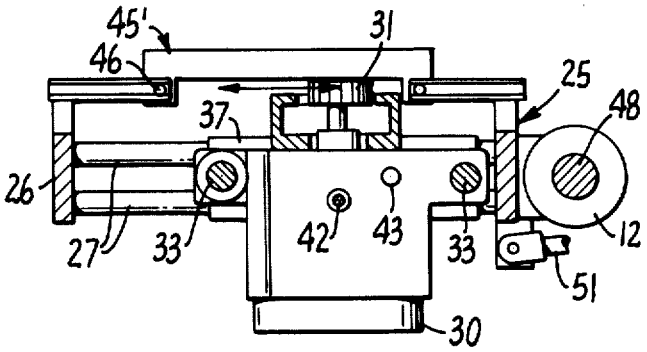
FIG. 7 is a cross-sectional view taken along line 7—7 of FIG. 6.

The butt mortiser is a router and comprises a vertically disposed, generally rectangular frame 25 having lateral side frame members 26 (FIGS. 3, 6, 7) and a horizontal lower member 27. An upwardly arched guard member 28 is at the upper end of the frame secured to upward extensions 29 of the side frame members.

Figure 5:
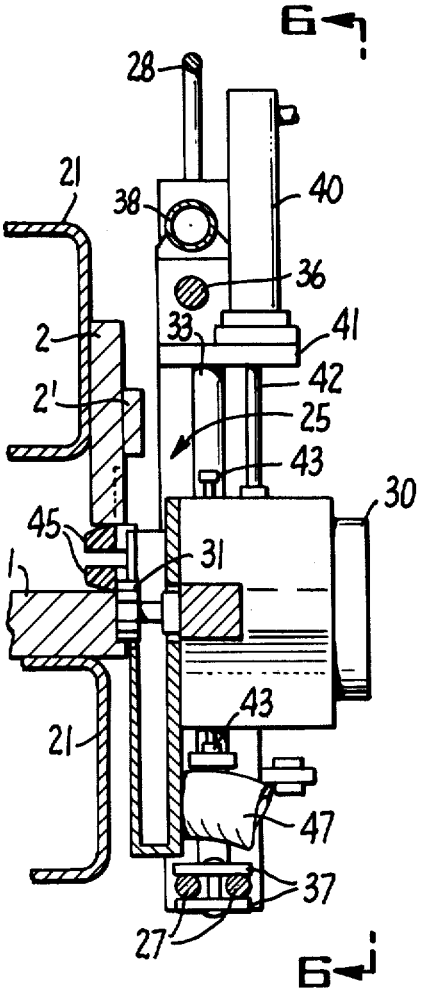
FIG. 5 is an enlarged sectional view as seen from line 5—5 of FIG. 4.

The main body of the router or mortiser, comprises an electric motor 30 (FIGS. 5–7) having a horizontally extending drive shaft provided with a routing cutter 31 on its outer end projecting from one side of frame 25. A block 32 supports the motor 30 for vertical reciprocatory movement on a pair of horizontally spaced rods 33. The upper ends of rods 33 are secured on an upper member 34 that is horizontally reciprocable on a horizontal rod 36, that, in turn, is secured at its ends on extensions 29 of frame 25 and which rod forms the upper side of frame 25. The lower ends of rods 33 are secured to a lower member 37 that is horizontally reciprocable on rod 27 that is the lower frame member of frame 25.

From the foregoing it is seen that the motor 30 and mortising cutter 31, or router, are supported for vertical and horizontal movement relative to frame 25.

A horizontally disposed, fluid actuatable cylinder 38 at the upper end of and rigid with frame 25 has its plunger rod 39 connected with an upward extension of the upper member 34 (FIG. 6) while a vertical fluid actuatable cylinder 40 supported on a portion of the upper member 34 has its plunger rod 42 connected with block 32 of motor 30. Vertically adjustable stops 43 are on block 32 limiting its vertical movement and laterally adjustable stops 35 limit lateral movement.

Figure 13:
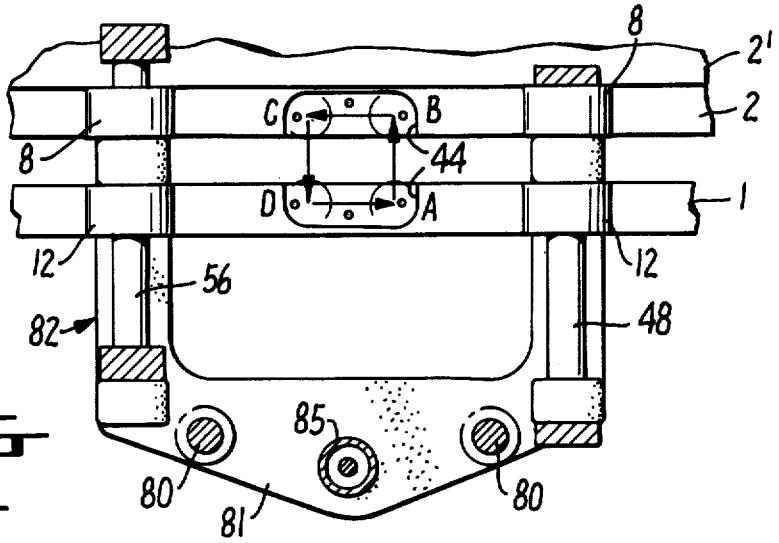
FIG. 13 is a part sectional, part elevational view showing a supporting casting for each assembly of hinge applying units and its position relative to areas of the door and jamb to which each hinge is to be applied.

As will later be explained, programmer controlled means operably connected with cylinders 40, 38 will automatically effect upward movement of the cutter 31 from point A (FIG. 13) to point B, and horizontal movement from point B to point C, and from point C downward to point D, and from the latter back to point A when the cutter is in cutting relation to the door 1 and the hinge jamb 2 (FIG. 5) to form the mortises 44 in the door and jamb shown in Sta. B of FIG. 2.

Figure 8:
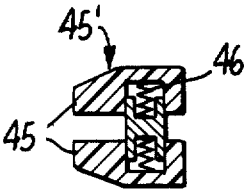
FIG. 8 is an enlarged cross-sectional view of an element shown in FIGS. 5, 6.

The upper and lower horizontally extending elements 45 of a chip breaker generally designated 45' are yieldably urged apart by springs 46 (FIG. 8). These elements are carried by frame 25 for wedging between the opposedly facing surfaces of the door 1 and jamb 2 closely adjacent the cutter 31 to reduce the possibility of the cutter breaking away the corners of the cut recesses or mortises for the hinge butts as the cutter crosses from door to jamb and vice versa, by adding to the support of the otherwise weak fibers of wood at the corner areas of the mortises.

Also, a vacuum line 47 communicates with the cutting area at each cutter to evacuate the cut material, whereby the air is clean and the cuttings are collected for disposal, eliminating fire hazard.

The frame 25 of each mortiser is swingably supported on a vertical shaft 48 (FIGS. 3, 6) on frame 21 for movement from a position extending outwardly at a right angle to frame 21 to a position facing said frame 21. A fluid actuatable cylinder 50 (FIG. 4) has its plunger rod 51 connected with frame 25 of the mortiser for swinging the latter to and from cutting position relative to the door and jamb.

An important feature of this invention is the provision of rollers 8 and 12 on vertical shaft 48. The same numbers for these rollers will be used in the description of both the mortiser and the drilling device 19. They are structurally alike and are correspondingly supported as a unit on frame 21 and on the vertical shaft that supports the mortiser in one instance and the drilling device in the other, which precludes any misalignment between the mortiser and drilling device and the door and jamb when the mortiser and drilling device of the assemblies 9, 10 are in cutting and drilling positions.

DRILLING DEVICE

The drilling unit 19 is spaced from the mortising unit 18, and comprises a frame generally designated 55 that is swingingly supported on a vertical shaft 56 carried by frame 21 in the same manner as shaft 48 for the mortiser.

A fluid actuatable cylinder 57 (FIG. 4) is connected by its plunger with frame 55 for swinging it from a position at a right angle to frame 21, and opposed to the mortiser when the latter is in its inoperative position, to a position in which one side of the frame is against the jamb 2 (FIG. 5), and vice versa.

Figure 9:
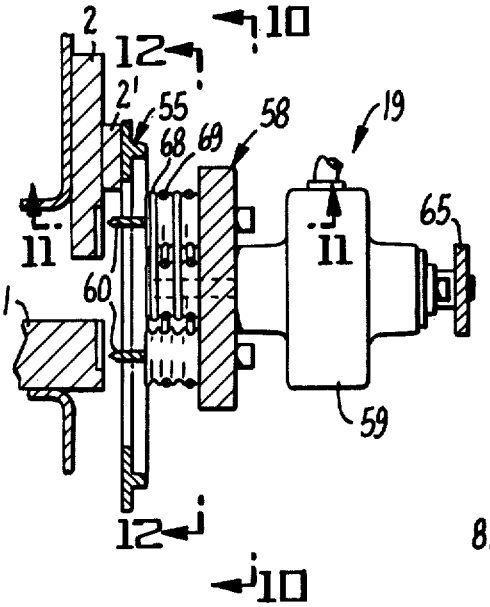
FIG. 9 is a part sectional, part elevational view of the drilling device for drilling the screw holes, shown in a position facing the mortised jamb and door preparatory to drilling the holes.

An auxiliary frame, generally designated 58, carries an air motor 59 and rotatable chucks that support six conventional drills 60 (FIG. 9).

Frame 58 is in a vertical plane parallel with and spaced from frame 55 in a direction away from the door 1 and jamb 2 when frame 55 is against said jamb, and with the drills 60 extending toward the door and jamb, three of the drills being opposite the mortise in jamb 2, and the other three being opposite the mortise on the edge of the door 1.

Figure 10:
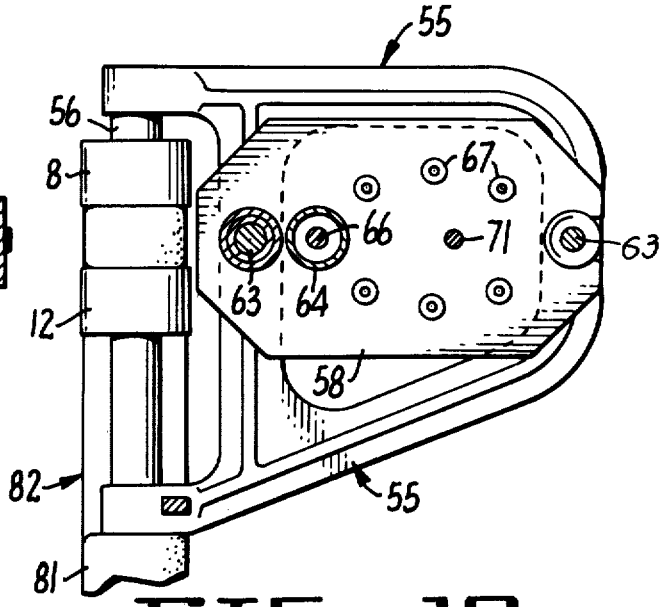
FIG. 10 is a sectional view taken along line 10—10 of FIG. 9.
Figure 11:
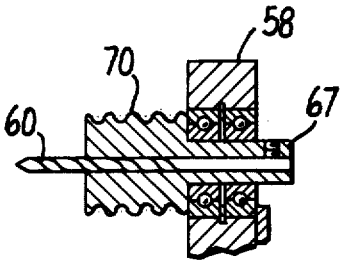
FIG. 11 is an enlarged cross-sectional view through a bearing for one of the drills, including the driving pulley.

Parallel horizontally extending rods 63 (FIGS. 4 and 10) slidably support the auxiliary frame 58 for movement toward frame 55 when the latter is against the jamb 2 for drilling the holes in the jamb and door to receive the screws for securing the butts of the butt hinge to the jamb and door.

A fluid actuatable cylinder 64 (FIG. 4) is secured at one of its ends to a vertical plate 65, which plate, in turn, is connected with and spaced from frame 55 by rods 63. Cylinder 64 projects toward auxiliary frame 58 and is connected with the latter by its plunger rod 66, for moving the frame 58 and the motor and drills carried thereby toward and away from the door 1 and jamb 2 when the frame 55 is against said jamb for drilling the screw receiving holes.

Figure 12:
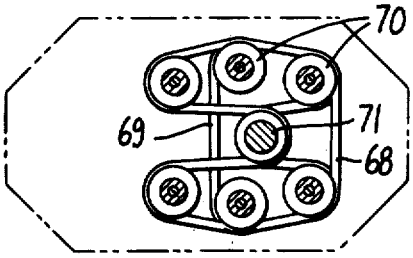
FIG. 12 is a cross-sectional view taken along line 12—12 of FIG. 9 showing the driving arrangement for the drills.

A pair of round belts 68, 69 (FIG. 12) extend over the pulleys 70 on the chucks that carry the drills 60, and over the motor driven pulley 71 for simultaneously rotating the drills 60 in the direction for drilling.

The pattern of the drills corresponds to the pattern of the holes in the butts of the hinges, and the fact that the rollers 8, 12 are on the same shaft that supports the drilling device on the main frame 21, and which rollers cooperate with the rollers 8, 12 that are on the shaft 48 of the mortiser for precluding misalignment, is an important feature.

HINGE CARRIER AND SCREWDRIVER

For brevity, each hinge carrier and screwdriver unit 20 will be called a screwdriver. In the present instance it is loaded with six screws for the pair of butts of each of the two hinges, three for a butt of each hinge, and when actuated, the twelve screws carried by the two screwdriver units will simultaneously secure the hinges to the door 1 and jamb 2.

In detail, each screwdriver 20 comprises a vertical frame generally designated 75 that includes a gear box 76 and a horizontally disposed shelf 77 that projects rearwardly from frame 75.

The words "forwardly" and "rearwardly" and words of similar meaning relate to locations or directions of movement with respect to the door 1 and jamb 2. The forward movement of the screwdriver is toward the door, and the rear end of an element is the end remote from the door.

The lowermost portion of frame 75 is formed with a pair of horizontally spaced openings through which extend horizontally extending, parallel bars 80, the forward ends of which are rigidly secured to the lower side 81 of a vertically disposed U-shaped casting 82 (FIG. 13), that, in turn, carries vertical shafts 48, 56 on the vertical arms thereof. Shafts 48, 56 are the hinge pins for swingingly supporting a mortiser 18 and the drilling device 19 and also the indexing rollers 8, 12. The casting 82 supporting each assembly is releasably secured to frame 21.

Figure 3:
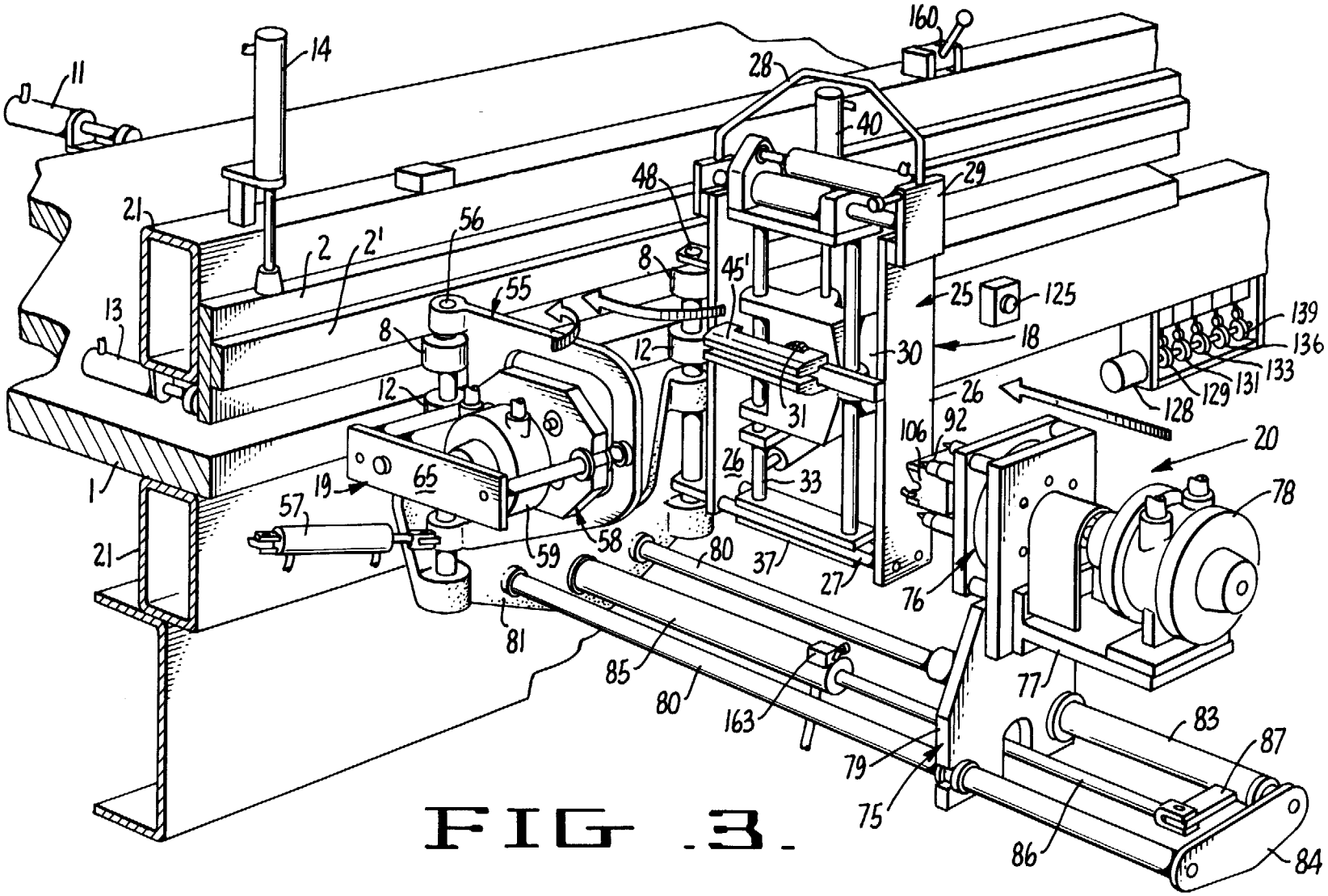
FIG. 3 is an enlarged perspective view of one of the hinge applying assemblies including portions of the door and hinge jamb and means for holding them in positions for application of a hinge.
Figure 4:
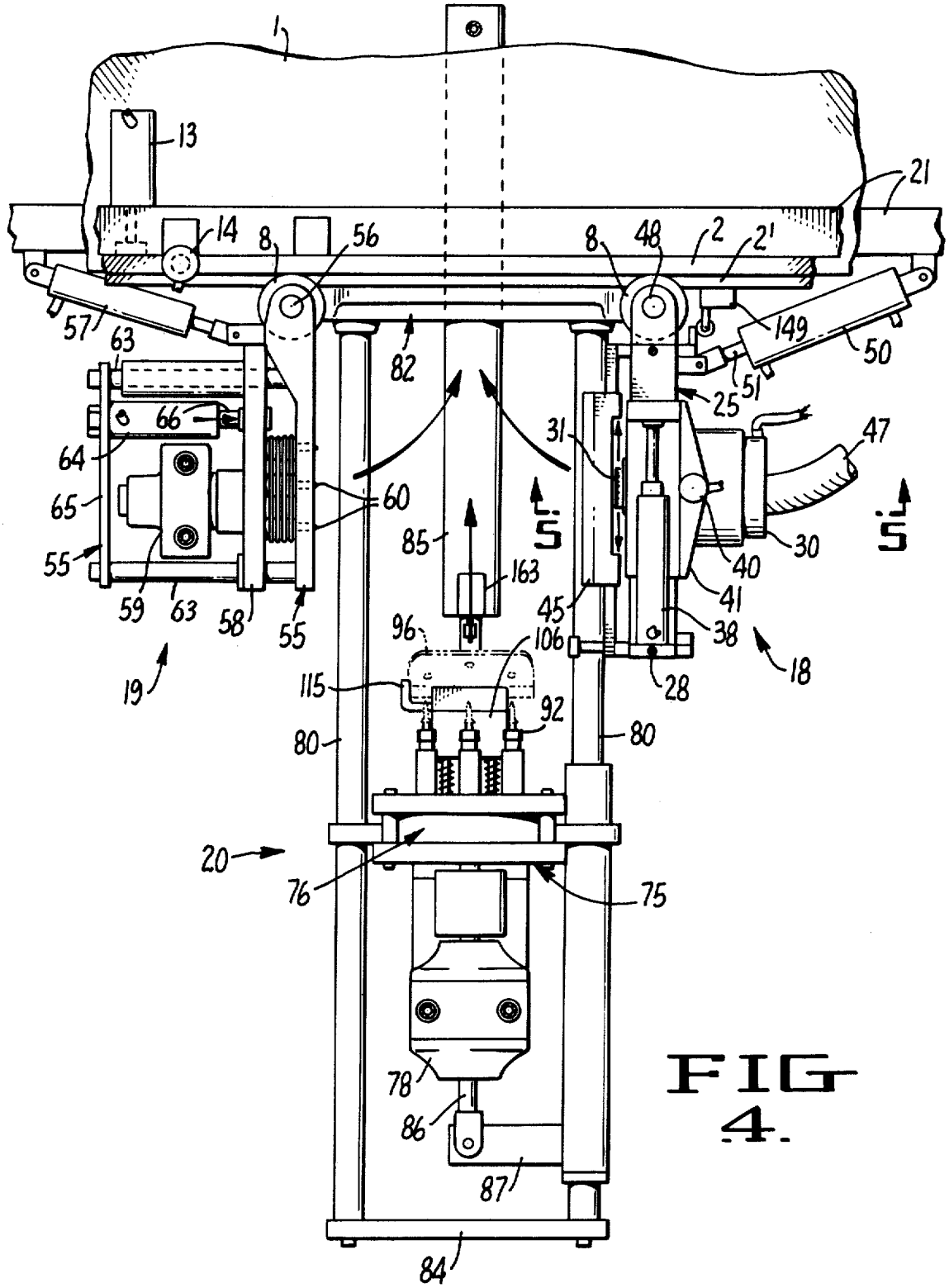
FIG. 4 is a top plan view of the assembly of FIG. 3.
Figure 14:
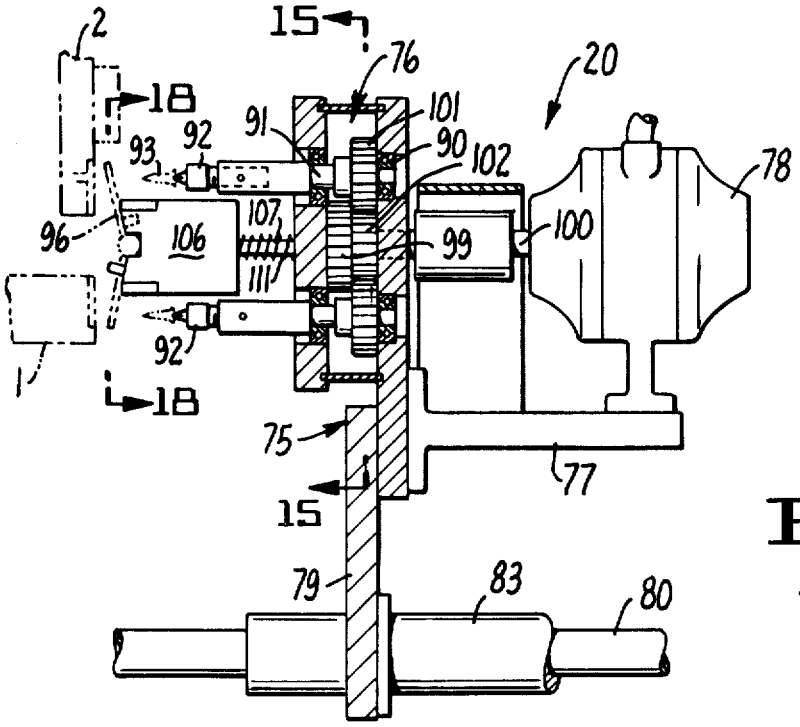
FIG. 14 is a vertical sectional view through the screw-applying and hinge-holding device.

A horizontally extending, elongated tubular bearing 83 is slidable on one of the bars 80, being coaxial therewith, and is secured at its forward end to the lower portion 79 of frame 75. Said bearing projects rearwardly from frame 75. The other bar 80 slidably extends through a bearing in the other hole in portion 79 (FIGS. 3, 4, 14). A cross bar 84 connects the rear ends of bars 80. Thusly frame 75 and all elements carried thereby are supported on bars 80 for reciprocable movement toward and away from the door 1 and jamb 2.

A fluid actuatable cylinder 85 (FIG. 3) extends through an opening in the lower portion 81 of casting 82 centrally between the forward ends of bars 80, and is rigidly secured to the casting 82. Plunger 86 of cylinder 85 extends from the rear end of the latter and its outer end is pivotally connected with a lateral extension 87 on the rear end of bearing 83 (FIGS. 3, 4). By this arrangement the frame 75 and the elements thereon are moved toward or away from the door 1 and jamb 2 by actuation of cylinder 85.

Within the gear box 76 are bearings 90 (FIG. 14) rotatably supporting horizontal shafts 91 that are parallel with bars 80, and which shafts support magnetic bit holders or screwdrivers 92 at their forward ends, each of which is adapted to magnetically hold a screw 93 of ferrous material thereon in axial alignment with the shaft supporting the holder. The screws are preferably of the Phillips type, as are the screwdrivers, to insure quick and accurate positioning and driving of the screws with their axes coaxial with the axes of shafts 91.

Figure 17:
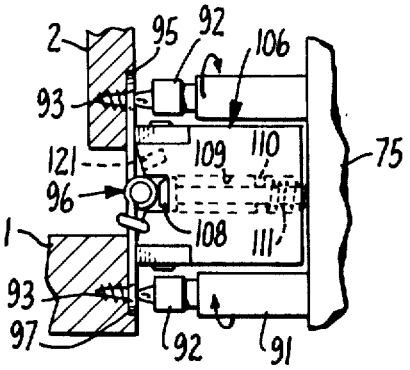
FIG. 17 is a view similar to that of FIG. 16 but showing the hinge secured to the hinge jamb and door with the screwdrivers and hinge holder still in engagement with the screws and hinge.

Shafts 91, which are six in number in the present instance, are in two sets of three each, one being an upper set in which the horizontal axes of the shafts 91 and holders 92 thereon are aligned with the screw holes in the upper butt 95 of a butt hinge 96 when the butts of the hinge are coplanar vertically in the mortises 44 formed in the door 1 and jamb 2 as seen in FIG. 17. The same alignment of the screwdrivers is provided for the shafts 91 and screwdrivers of the lower set with reference to the screw holes in the lower butt 97 of each hinge 96.

Figure 15:
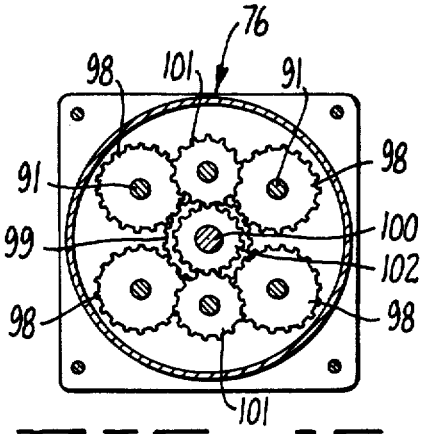
FIG. 15 is a cross-sectional view showing the gear trains for the screwdrivers, as seen from line 15—15 of FIG. 14.

Spur gears 98 on the outermost of the three shafts 91 of the upper and lower sets are driven in the same direction by a central gear 99 on a central motor-driven shaft 100 (FIG. 15) while the central gears 101 of the upper and lower sets are simultaneously driven in the same direction as gears 98 by a gear 102 secured on the central shaft 100. In this manner all the screwdrivers are positively driven in the same direction, for driving the screws into the door and jamb when the screwdriver units 20 are moved toward the door 1 and jamb 2, as will be explained.

A generally rectangular block 106, which will be called a hinge chuck, is supported on a pair of horizontally spaced, parallel rods 107 (FIGS. 14, 16) in a position spaced forwardly of the six magnetic bits or screw holders 92 for movement of frame 75 toward and away from the door 1 and jamb 2.

Figure 16:
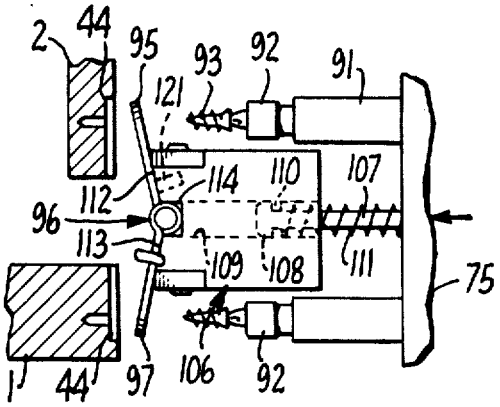
FIG. 16 is an enlarged fragmentary view of a pair of the screwdrivers and the hinge support in a position facing the mortises preparatory to positioning and securing the hinge to the hinge jamb and door by the screws carried by the screwdrivers, the hinge jamb and door being shown in cross section.

The rods 107 have cylindrical heads 108 at their forward ends that are slidable within cylindrical parallel bores within the chuck 106 (FIG. 16). The rear ends of the rods are secured on part of the frame 75. A radially inwardly projecting shoulder 110 within each bore 109 between head 108 and the rear side of the chuck 106 functions as a stop for engaging the head 108 and limiting the forward movement of the chuck, and a helical spring 111 around each rod reacts between the shoulder and frame 75 to yieldably resist rearward movement of the chuck 106, while permitting such movement under a predetermined force applied by the fluid actuatable cylinder 85.

The face of the hinge chuck 106 that generally faces the door 1 and jamb 2 has parallel, horizontally extending upper and lower surfaces 112, 113 that extend divergently, transversely from the upper and lower edges of a central, horizontally extending recess 114 formed in the hinge chuck 106. Recess 114 is adapted to receive the loops on the hinge butts 95, 97 for the hinge pin.

Figure 18:
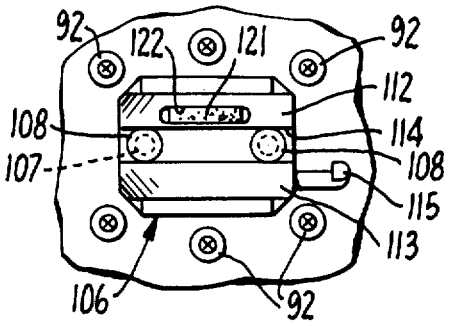
FIG. 18 is a fragmentary elevational view as seen from line 18—18 of FIG. 14.

A hinge positioning angle arm 115 (FIG. 18) is carried by and adapted to be adjustably positioned and held in adjusted position for engagement with one end of a hinge to accurately position the hinge relative to the mortises in door 1 and jamb 2 to receive its butts.

Within the chuck (which is non-magnetic, such as aluminum) is secured a permanent, horizontally elongated magnet 121 exposed through and adjacent an opening 122 in the upper forward face 112 of the hinge chuck.

Door hinges are substantially all of ferrous or magnetic material, and upon an operator positioning a hinge 96 so its hinge loops for the hinge pin are in the recess 114, the butts 95, 97 will be against the surfaces 112, 113 with one end of the hinge being positioned against the hinge positioning arm 115. The hinge will then be magnetically held with its butts flat against the divergently disposed surfaces 112, 113, and partially folded (FIG. 16). In this position the hinge will be directly opposite the mortises 44 (FIG. 2). Upon the screwdriver being moved toward door 1 and jamb 2 under the influence of the cylinder 85, it is apparent that the horizontal width of the hinge will be slightly less than the total width of the mortises, hence the butts of the hinge will freely enter the mortises. Continued movement of the frame 75 toward the door and hinge after the outermost lateral edges of the butts on the hinge have engaged the bottom surfaces of the mortises will result in the butts being firmly seated in the mortises against said surfaces and firmly held by the chuck 106 along the divergent edges of faces 112, 113. Thereafter the magnetic screw holders, rotating by air motor 78, will simultaneously drive the screws 93 through the screw holes in the butts and into the door and jamb to firmly secure the hinge to the door and jamb. The screwdrivers and hinge chuck will then retract, and the motor will stop for reloading the bits and hinge chuck.

OPERATION (MORTISER & DRILLS)

Figure 19:
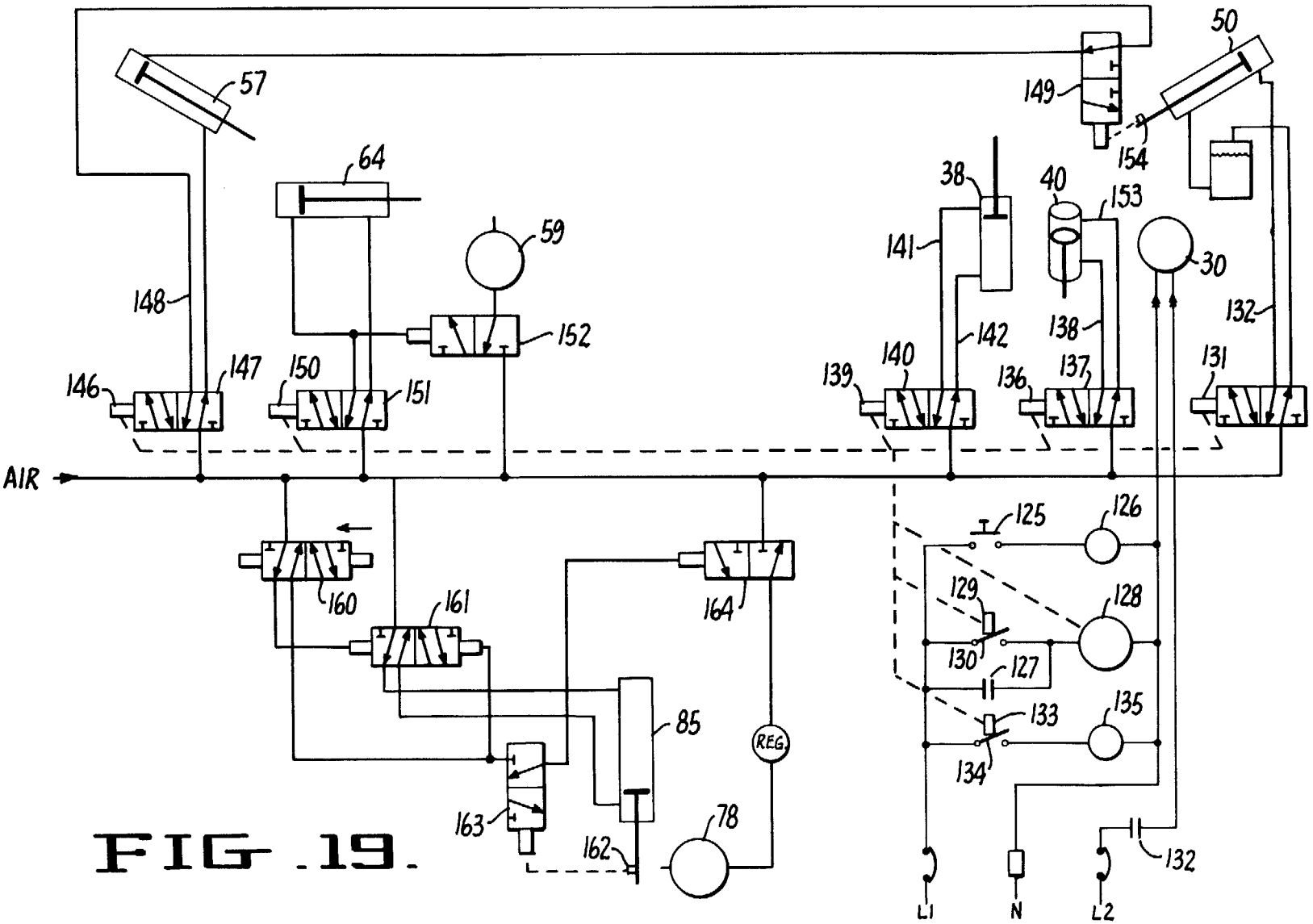
FIG. 19 is a schematic view of the control system for the actuating elements for the system.

Referring to FIG. 19, to start the mortisers and drilling devices 18, switch 125 is manually actuated by an operator standing between the two assemblies 9, 10. The closing of switch 125 effects energization of coil 126 of a time delay relay 127. This completes a circuit to the programmer motor 128, starting the programmer.

Cam 129 actuated by the programmer closes kill switch 130 to maintain actuation of the programmer when relay 127 times out.

Cam 131 is now actuated by the programmer to connect line 132 with the swing-in cylinder 50 to swing the mortiser into routing position, and cam 133, also actuated by the programmer, closes switch 134 and draws in the coil of relay 135 closing the contacts 132 which completes the electrical circuit to motor 30 for actuating the cutter 31.

Cam 136 actuated valve 137 connects fluid pressure line 138 with cylinder 40 to move the motor 30 and cutter 31 (FIG. 4) upwardly from point A to point B (FIG. 13), and cam 139 actuates valve 140 to connect line 141 with cylinder 38 to retract said cylinder causing movement of the cutter from point B to point C, after which cam 136 is actuated to connect pressure line 153 with cylinder 40 to extend cylinder 40 for moving cutter from point C to point D. Cam 139 is now actuated to connect line 142 with cylinder 38 to extend the latter to move the cutter 31 from point D back to point A.

The mortising now being completed, the programmer actuated cam 131 is actuated to swing the mortiser back to rest position, and simultaneously the cam 133 de-energizes switch 134 which opens the contacts of the switch de-energizing the coil of the relay 135 thereby turning off the mortiser motor 30.

After the mortiser 18 is in its rest position, the programmer actuated cam 146 actuates valve 147 to connect pressure line 148 with the swing-in cylinder 57 (FIG. 3) of the drill unit 19 to swing it to drilling position. Safety valve 149 has been actuated by the mortiser 18 to extend safety latch 154 to prevent the drill unit from swinging in while the mortiser is in and is swinging to its rest position.

Cam 150 actuates the drill-plunge valve 151 which extends the drill-plunge cylinder 64 (FIG. 4) and simultaneously energizes the drill-motor valve 152 which starts the drill motor 59, causing the drills to rotate.

While the drills are so rotating and are being carried forwardly and into the door 1 and jamb 2, cam 150 actuates the valve 151 to retract the cylinder 64 and simultaneously de-energizes the drill motor valve 152 which stops the motor 59. The drill bits stop rotating and retract from the door and jamb.

Cam 146 is now actuated to operate the valve 147 to retract the swing-in cylinder 57 causing the drill unit to move to rest position.

Cam 129 now actuates the programmer kill switch 130 opening the contacts of the switch, causing the programmer to stop. This completes the automatic mortising and drilling cycle.

OPERATION OF SCREWDRIVER

The operator, standing adjacent the assembly 9 actuates a foot valve (not shown) which actuates the transfer cylinder 4 to move the door 1 and the jamb 2 attached thereto to the right (FIG. 1) for engagement of power rollers with the door to clear the machine, and to move door 1' onto the machine where it will be automatically positioned by the door positioning cylinders 6.

During the transfer of the doors 1 and 1' the operator loads the screwdrivers of assembly 9 and then positions a jamb 2 which is clamped in position and actuates the mortiser and drill, and during the automtic sequence of the mortiser and drill the screwdrivers of assembly 10 are loaded.

Valve 160 (FIG. 3) is then manually actuated. Actuation of valve 160 energizes the screwdriver cylinder valve 161 which retracts the screwdriver cylinder 85 (FIG. 3) causing the screwdriver units to move toward the door 1 and jamb 2. An actuator 162 (FIG. 19) mounted on the screwdriver unit engages the screwdriver motor pilot valve 163 which energizes the motor power valve 164 which, in turn, starts the screwdriver motor 78, causing the magnetic screwdriver bits 92 (FIG. 16) to rotate.

The screwdriver unit continues to move toward the door and jamb, flattening the hinges in the mortises 44, and driving the screws 93 (FIG. 17) into the door and jamb until the resisting torque of the six screws of each unit exceeds the torque of the air driven motor driving them, resulting in stalling the motor. At this time the operator manually de-energizes the valve 160 which de-energizes the cylinder valve 161 extending the screwdriver cylinder 85 and simultaneously de-energizing the screwdriver motor power valve 164, thereby stopping the motor 78 causing the unit to turn off and return to rest position.

I claim:

1. An apparatus for hingedly connecting an adjacent pair of work members each having elongate butt-receiving surfaces, by conventional hingedly connected butt hinges each having butts to be seated in mortises of outlines corresponding to the outlines of the butts, and each butt having a plurality of screw holes in a predetermined pattern for screws to secure said butts in said mortises;

(a) means for supporting said work members and means connected to said work member supporting means for holding said butt-receiving surfaces having said mortises therein spaced apart in the same vertical plane and facing in the same direction for receiving the butts of said butt hinge in said mortises;

(b) a screwdriver unit, and means connected to said work member supporting means for supporting said unit for movement to and from said mortises when said work members are supported in said positions, and unit-moving means connected with said unit for so moving it;

(c) hinge supporting means movably mounted on said unit, said hinge supporting means including resilient means biasing said hinge supporting means in advance of said screwdriver unit prior to its engagement with the butt-receiving surfaces, said hinge supporting means releasably supporting said hinge thereon for movement therewith to said mortises and for firmly seating the butts of said hinge in said mortises with one butt in the mortise in one work member and the other in the mortise in the other work member and for holding said butts in said mortises until the butts are screwed to the work members;

(d) a plurality of screwdriver bits rotatably supported on said unit for movement therewith each in alignment with one of the holes in said butts when said butts are seated in said mortises and means for releasably holding a screw on each bit in said alignment with one of the holes in said butts;

(e) means supporting said bits for simultaneous movement relative to said hinge supporting means for simultaneously driving said screws through the holes in said butts and into said work members when said butts are seated in said mortises; and (f) means for simultaneously rotating said bits during driving of said screws by said bits and while said hinge is held by said hinge supporting means.

2. In apparatus as defined in claim 1:

(g) said hinge supporting means and said bits including magnetic means for releasably holding said hinge and screws, and said hinge and screws being releasable from said magnetic means upon movement of said unit in a direction away from said work member after said screws have firmly secured said butts in said mortises.

3. An apparatus for hingedly connecting an adjacent pair of work members each having elongate butt-receiving surfaces, by conventional hingedly connected butt hinges each having butts to be seated in mortises of outlines corresponding to the outlines of the butts, and each butt having a plurality of screw holes in a predetermined pattern for screws to secure said butts in said mortises;

(a) means for supporting said work members in positions so that said butt-receiving surfaces having said mortises therein are adjacent, parallel, and facing in the same direction for receiving the butts of said butt hinge in said mortises;

(b) a screwdriver unit, and means connected to said work member supporting means for supporting said unit for movement to and from said mortises when said work members are supported in said positions, and unit-moving means connected with said unit for so moving it;

(c) hinge supporting means mounted on said unit for releasably supporting said hinge thereon for movement therewith to said mortises and for firmly seating the butts of said hinge in said mortises with one butt in the mortise in one work member and the other in the mortise in the other work member and for holding said butts in said mortises until the butts are screwed to the work members;

(d) a plurality of screwdriver bits rotatably supported on said unit for movement therewith each in alignment with one of the holes in said butts when said butts are seated in said mortises and means for releasably holding a screw on each bit in said alignment with one of the holes in said butts;

(e) Means for simultaneously rotating said bits during driving of said screws by said bits and while said hinge is held by said hinge supporting means;

(f) said hinge supporting means comprising a body formed with butt-engaging surfaces facing the direction of movement thereof toward said mortises for supporting said butts in positions extending divergently relative to each other with their divergent edges spaced apart a lesser distance than the correspondingly positioned sides of the mortises to receive them to facilitate entrance of said butts into said mortises; and (g) said divergent edges engaging said butts at points spaced from said edges toward the hinged connection between said butts, whereby continued movement of said hinge supporting means toward said mortises after engagement of said divergent edges with said mortises will fully seat said butts in said mortises and whereby said body will hold said butts seated during the driving of said screws through the holes in said butts and into said door and jamb.

4. The apparatus as defined in claim 3, including:

(i) a permanent magnet in one of said butt-engaging surfaces for releasably holding said butts against said butt engaging surfaces.

5. In apparatus as defined in claim 3:

(i) said hinge supporting means including a support supporting said bits for said continued movement after said divergent edges of said divergent butts have engaged said mortises for so driving said screws into said work members.

6. In apparatus as defined in claim 5:

(j) said means for simultaneously driving said screws being a motor on said support and a driving connection between said motor and said bits, and means for controlling the driving torque transmitted to said screws for rendering it inoperative upon the resistance to rotation of said bits exceeding the driving torque of said motor.

7. In apparatus as defined in claim 6:

(k) said motor being air actuated for driving said bits.

8. In apparatus for hingedly connecting a door and a jamb, each having a flat, butt-receiving surface respectively defining one edge of the door and a longitudinally extending side of said jamb, by butt hinges, each comprising a pair of hingedly connected butts respectively formed with a plurality of screw openings, one butt to be seated in a mortise formed in the butt-receiving surface of said door and the other to be seated in the butt-receiving surface of said jamb, an assembly of units for forming the mortises for each hinge, for drilling screw holes in said mortises, and for securing the hinge butts in said mortises, comprising:

(a) means for supporting said door and jamb in positions with said surfaces coplanar facing in the same direction with said jamb parallel with said edge of said door and adjacent thereto;

(b) a mortiser having a cutter for forming the mortises in a predetermined area in each of said surfaces of said door and jamb for the butts of said hinge;

(c) a drilling unit having a plurality of drills for drilling screw holes for said butts in the mortises formed in said predetermined areas;

(d) a hinge seating and screw driving unit for supporting and seating one of the butts of said hinge in each of the mortises in said areas and a plurality of bits on said unit for supporting and driving screws through the holes in said butts and into holes drilled in the mortises in said areas for securing said hinge to said door and jamb;

(e) pivots for supporting said mortiser and drilling unit at fixed points relative to said areas for swinging said mortiser and drilling unit about parallel axes, one after the other, to and away from said areas for forming said mortises and said screw holes when said door and jamb are in said positions;

(f) a rigid amount supporting said pivots at said fixed points, and said means for supporting said door and jamb in said positions for mortising and drilling including elements on said pivots in engagement with said surfaces; and means on said rigid mount for supporting said hinge and screw driving unit for movement to and from said mortises for seating the butts of the hinge carried thereby in said mortises and for driving screws on said bits through the holes in said butts and into holes drilled in said mortises for securing said butts in said mortises.

* * * * *